US009729976B2

(12) United States Patent
Natarajan

(10) Patent No.: US 9,729,976 B2
(45) Date of Patent: Aug. 8, 2017

(54) ACOUSTIC FEEDBACK EVENT MONITORING SYSTEM FOR HEARING ASSISTANCE DEVICES

(75) Inventor: Harikrishna P. Natarajan, Shakopee, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 687 days.

(21) Appl. No.: 12/644,932

(22) Filed: Dec. 22, 2009

(65) Prior Publication Data

US 2011/0150231 A1 Jun. 23, 2011

(51) Int. Cl.
*H04R 29/00* (2006.01)
*H04R 25/00* (2006.01)

(52) U.S. Cl.
CPC ..... *H04R 25/453* (2013.01); *H04R 25/305* (2013.01); *H04R 25/558* (2013.01); *H04R 2225/39* (2013.01); *H04R 2225/41* (2013.01)

(58) Field of Classification Search
CPC H04R 25/453; H04R 25/305; H04R 2225/41; H04R 2225/39; H04R 25/558; H04R 25/30; H04R 2430/03
USPC ..... 381/60, 93, 318, 95, 94.3, 94.2; 700/94
See application file for complete search history.

(56) References Cited

U.S. PATENT DOCUMENTS 4,471,171 A 9/1984 Kopke et al.
4,972,482 A 11/1990 Ishiguro et al.
4,972,487 A 11/1990 Mangold et al.
4,989,251 A 1/1991 Mangold
5,170,434 A 12/1992 Anderson
5,226,086 A 7/1993 Platt
5,604,812 A 2/1997 Meyer
5,606,620 A 2/1997 Weinfurtner
5,659,622 A 8/1997 Ashley
5,706,352 A 1/1998 Engebretson et al.
5,724,433 A 3/1998 Engebretson et al.
5,838,806 A 11/1998 Sigwanz et al.
5,987,146 A * 11/1999 Pluvinage et al. ..... 381/328
5,991,419 A 11/1999 Brander
6,035,050 A 3/2000 Weinfurtner et al.
6,044,183 A 3/2000 Pryor
6,104,993 A 8/2000 Ashley
6,240,192 B1 5/2001 Brennan et al.
(Continued)

FOREIGN PATENT DOCUMENTS

EP 250679 A2 1/1988
EP 0396831 A2 11/1990
(Continued)

OTHER PUBLICATIONS

"U.S. Appl. No. 12/408,928, Non Final Office Action mailed Aug. 4, 2011", 25 pgs.
(Continued)

*Primary Examiner* — Vivian Chin
*Assistant Examiner* — Con P Tran
(74) *Attorney, Agent, or Firm* — Schwegman Lundberg & Woessner, P.A.

(57) ABSTRACT

The present disclosure relates to tracking of acoustic feedback events of a hearing assistance device, such as a hearing aid. Information about the acoustic feedback events is stored for analysis. Such information is useful for programming acoustic feedback cancellers and other parameters of a hearing assistance device.

27 Claims, 3 Drawing Sheets

(56) References Cited

U.S. PATENT DOCUMENTS

| | | | | |
|---|---|---|---|---|
| 6,275,596 | B1 * | 8/2001 | Fretz et al. | 381/321 |
| 6,718,301 | B1 | 4/2004 | Woods | |
| 6,882,736 | B2 | 4/2005 | Dickel et al. | |
| 6,885,752 | B1 | 4/2005 | Chabries et al. | |
| 6,912,289 | B2 | 6/2005 | Vonlanthen et al. | |
| 7,006,646 | B1 | 2/2006 | Baechler | |
| 7,068,802 | B2 | 6/2006 | Schulz et al. | |
| 7,088,835 | B1 | 8/2006 | Norris et al. | |
| 7,242,777 | B2 | 7/2007 | Leenen et al. | |
| 7,283,638 | B2 | 10/2007 | Troelsen et al. | |
| 7,283,842 | B2 | 10/2007 | Berg | |
| 7,349,549 | B2 | 3/2008 | Bachler et al. | |
| 7,428,312 | B2 | 9/2008 | Meier et al. | |
| 7,519,193 | B2 | 4/2009 | Fretz | |
| 7,889,879 | B2 | 2/2011 | Dillon et al. | |
| 7,986,790 | B2 | 7/2011 | Zhang et al. | |
| 8,116,473 | B2 | 2/2012 | Salvetti et al. | |
| 8,571,244 | B2 | 10/2013 | Salvetti | |
| 8,638,949 | B2 | 1/2014 | Zhang et al. | |
| 8,917,891 | B2 | 12/2014 | Natarajan | |
| 8,942,398 | B2 | 1/2015 | Salvetti et al. | |
| 2001/0055404 | A1 | 12/2001 | Bisgaard | |
| 2002/0012438 | A1 | 1/2002 | Leysieffer et al. | |
| 2002/0025055 | A1 | 2/2002 | Stonikas et al. | |
| 2002/0039426 | A1 | 4/2002 | Takemoto et al. | |
| 2002/0051546 | A1 | 5/2002 | Bizjak | |
| 2002/0057814 | A1 | 5/2002 | Kaulberg | |
| 2003/0007647 | A1 | 1/2003 | Nielsen et al. | |
| 2003/0112988 | A1 | 6/2003 | Naylor | |
| 2004/0066944 | A1 * | 4/2004 | Leenen et al. | 381/314 |
| 2004/0125973 | A1 * | 7/2004 | Fang et al. | 381/318 |
| 2004/0136557 | A1 | 7/2004 | Kaulberg | |
| 2004/0190739 | A1 | 9/2004 | Bachler et al. | |
| 2004/0202340 | A1 | 10/2004 | Armstrong et al. | |
| 2004/0218772 | A1 | 11/2004 | Ryan | |
| 2005/0047620 | A1 | 3/2005 | Fretz | |
| 2005/0069162 | A1 | 3/2005 | Haykin et al. | |
| 2005/0111683 | A1 | 5/2005 | Chabries et al. | |
| 2005/0129262 | A1 | 6/2005 | Dillon et al. | |
| 2005/0283263 | A1 | 12/2005 | Eaton et al. | |
| 2006/0173259 | A1 * | 8/2006 | Flaherty et al. | 600/331 |
| 2006/0215860 | A1 | 9/2006 | Wyrsch | |
| 2006/0222194 | A1 * | 10/2006 | Bramslow et al. | 381/314 |
| 2006/0227987 | A1 * | 10/2006 | Hasler | 381/314 |
| 2007/0009123 | A1 | 1/2007 | Aschoff et al. | |
| 2007/0019817 | A1 | 1/2007 | Siltmann | |
| 2007/0036280 | A1 * | 2/2007 | Roeck et al. | 379/52 |
| 2007/0116308 | A1 | 5/2007 | Zurek et al. | |
| 2007/0117510 | A1 | 5/2007 | Elixmann | |
| 2007/0135862 | A1 | 6/2007 | Nicolai et al. | |
| 2007/0217620 | A1 | 9/2007 | Zhang et al. | |
| 2007/0217629 | A1 | 9/2007 | Zhang et al. | |
| 2007/0219784 | A1 | 9/2007 | Zhang et al. | |
| 2007/0237346 | A1 | 10/2007 | Fichtl et al. | |
| 2007/0269065 | A1 | 11/2007 | Kilsgaard | |
| 2007/0276285 | A1 | 11/2007 | Burrows et al. | |
| 2007/0280487 | A1 | 12/2007 | Ura et al. | |
| 2008/0019547 | A1 | 1/2008 | Baechler | |
| 2008/0037798 | A1 | 2/2008 | Baechler et al. | |
| 2008/0063228 | A1 | 3/2008 | Mejia et al. | |
| 2008/0107296 | A1 | 5/2008 | Bachler et al. | |
| 2008/0130927 | A1 | 6/2008 | Theverapperuma et al. | |
| 2008/0260190 | A1 | 10/2008 | Kidmose | |
| 2009/0154741 | A1 | 6/2009 | Woods et al. | |
| 2009/0245552 | A1 | 10/2009 | Salvetti | |
| 2010/0111339 | A1 | 5/2010 | Sira | |
| 2011/0249846 | A1 | 10/2011 | Natarajan | |
| 2011/0249847 | A1 | 10/2011 | Salvetti et al. | |
| 2012/0155664 | A1 | 6/2012 | Zhang et al. | |

FOREIGN PATENT DOCUMENTS

| | | | |
|---|---|---|---|
| EP | 250679 | B1 | 7/1993 |
| EP | 0335542 | B1 | 12/1994 |
| EP | 712263 | A1 | 5/1996 |
| EP | 712263 | B1 | 1/2003 |
| EP | 1256258 | B1 | 3/2005 |
| EP | 1538868 | A2 | 6/2005 |
| EP | 1624719 | A2 | 2/2006 |
| EP | 1708543 | A1 | 10/2006 |
| EP | 1835784 | A1 | 9/2007 |
| EP | 2003928 | A1 * | 12/2008 |
| WO | WO-0154456 | A1 | 7/2001 |
| WO | WO-03045108 | A2 | 5/2003 |
| WO | WO-03098970 | A1 | 11/2003 |
| WO | WO-2005002433 | A1 | 1/2005 |
| WO | WO-2005018275 | A2 | 2/2005 |
| WO | WO-2007020299 | A2 | 2/2007 |
| WO | WO-2007045276 | A1 | 4/2007 |
| WO | WO-2007112737 | A1 | 10/2007 |
| WO | WO-2009068028 | A1 | 6/2009 |
| WO | WO-2009124550 | A1 | 10/2009 |

OTHER PUBLICATIONS

"U.S. Appl. No. 11/276,793, Non-Final Office Action mailed May 12, 2009", 20 pgs.

"U.S. Appl. No. 11/276,793, Response filed Nov. 11, 2009 to Non Final Office Action mailed May 12, 2009", 16 pgs.

"U.S. Appl. No. 11/276,795, Advisory Action mailed Jan. 12, 2010", 13 pgs.

"U.S. Appl. No. 11/276,795, Final Office Action mailed Oct. 14, 2009", 15 pgs.

"U.S. Appl. No. 11/276,795, Non Final Office Action mailed May 7, 2009", 13 pgs.

"U.S. Appl. No. 11/276,795, Non-Final Office Action mailed May 27, 2010", 14 Pgs.

"U.S. Appl. No. 11/276,795, Pre-Appeal Brief Request mailed Feb. 16, 2010", 4 pgs.

"U.S. Appl. No. 11/276,795, Response filed Sep. 8, 2009 to Non-Final Office Action mailed May 7, 2009", 10 pgs.

"U.S. Appl. No. 11/276,795, Response filed Dec. 14, 2009 to Final Office Action mailed Oct. 14, 2009", 10 pgs.

"European Application Serial No. 07250920, Extended European Search Report mailed May 11, 2007", 6 pgs.

"European Application Serial No. 08253924.8, Search Report mailed on Jul. 1, 2009", 8 pgs.

Mueller, Gustav H, "Data logging: It's popular, but how can this feature be used to help patients?", *The Hearing Journal* vol. 60, No. 10,, XP002528491, (Oct. 2007), 6 pgs.

Preves, David A., "Field Trial Evaluations of a Switched Directional/Omnidirectional In-the-Ear Hearing Instrument", *Journal of the American Academy of Audiology*, 10(5), (May 1999), 273-283.

"U.S. Appl. No. 11/276,795, Decision on Pre-Appeal Brief Request mailed Apr. 14, 2010", 2 pgs.

"U.S. Appl. No. 11/276,795, Examiner Interview Summary filed Mar. 11, 2011", 1 pg.

"U.S. Appl. No. 11/276,795, Examiner Interview Summary mailed Feb. 9, 2011", 3 pgs.

"U.S. Appl. No. 11/276,795, Final Office Action mailed Nov. 24, 2010", 17 pgs.

"U.S. Appl. No. 11/276,795, Notice of Allowance mailed Mar. 18, 2011", 12 pgs.

"U.S. Appl. No. 11/276,795, Response filed Jan. 21, 2011 to Final Office Action mailed Nov. 24, 2010", 11 pgs.

"U.S. Appl. No. 11/276,795, Response filed Sep. 28, 2010 to Non Final Office Action mailed May 27, 2010", 6 pgs.

"U.S. Appl. No. 12/408,928, Preliminary Amendment mailed Jun. 24, 2009", 3 pgs.

"European Application Serial No. 09250817.5, Extended European Search Report mailed Nov. 18, 2010", 7 pgs.

"U.S. Appl. No. 12/408,928, Notice of Allowance mailed May 11, 2012", 9 pgs.

"U.S. Appl. No. 12/408,928, Response filed Feb. 6, 2012 to Non Final Office Action mailed Aug. 4, 2011", 23 pgs.

Taylor, Jennifer Suzanne, "Subjective versus objective measures of daily listening environments", Independent Studies and Capstones. Paper 492. Program in Audiology and Communication Sciences,

(56) References Cited

OTHER PUBLICATIONS

Washington University School of Medicine., http://digitalcommons.wustl.edu/pacs_capstones/492, (2007), 50 pgs.
"U.S. Appl. No. 12/408,928, Preliminary Amendment filed Jun. 22, 2011", 11 pgs.
"U.S. Appl. No. 13/085,033, Advisory Action mailed Nov. 7, 2013", 3 pgs.
"U.S. Appl. No. 13/085,033, Non Final Office Action mailed Mar. 6, 2014", 12 pgs.
"U.S. Appl. No. 13/085,033, Response filed Oct. 28, 2013 to Final Office Action mailed Aug. 26, 2013", 10 pgs.
"U.S. Appl. No. 13/085,042, Notice of Allowance mailed Mar. 17, 2014", 5 pgs.
"U.S. Appl. No. 13/189,990, Notice of Allowance mailed Sep. 18, 2013", 15 pgs.
"U.S. Appl. No. 12/408,928, Notice of Allowance mailed Jun. 24, 2013", 10 pgs.
"U.S. Appl. No. 13/085,033 , Response filed Apr. 9, 2013 to Non Final Office Action mailed Nov. 9, 2012", 8 pgs.
"U.S. Appl. No. 13/085,033, Final Office Action mailed Aug. 26, 2013", 12 pgs.
"U.S. Appl. No. 13/085,033, Non Final Office Action mailed May 2, 2013", 10 pgs.
"U.S. Appl. No. 13/085,033, Non Final Office Action mailed Nov. 9, 2012", 9 pgs.
"U.S. Appl. No. 13/085,033, Response filed Aug. 2, 2013 to Non Final Office Action mailed May 2, 2013", 8 pgs.
"U.S. Appl. No. 13/085,042, Response filed Apr. 9, 2013 to Non Final Office Action mailed Nov. 9, 2012", 8 pgs.
"U.S. Appl. No. 13/085,042, Final Office Action mailed May 6, 2013", 10 pgs.
"U.S. Appl. No. 13/085,042, Non Final Office Action mailed Nov. 9, 2012", 9 pgs.
"U.S. Appl. No. 13/085,042, Notice of Allowance mailed Jul. 25, 2013", 6 pgs.
"U.S. Appl. No. 13/085,042, Response filed Jul. 8, 2013 to Final Office Action mailed May 6, 2013", 8 pgs.
"U.S. Appl. No. 13/189,990, Advisory Action mailed Aug. 1, 2013", 3 pgs.
"U.S. Appl. No. 13/189,990, Final Office Action mailed May 22, 2013", 15 pgs.
"U.S. Appl. No. 13/189,990, Non Final Office Action mailed Nov. 26, 2012", 12 pgs.
"U.S. Appl. No. 13/189,990, Preliminary Amendment filed Mar. 5, 2012", 37 pgs.
"U.S. Appl. No. 13/189,990, Response filed Feb. 27, 2013 to Non Final Office Action mailed Nov. 26, 2012", 8 pgs.
"U.S. Appl. No. 13/189,990, Response filed Jul. 22, 2013 to Final Office Action mailed May 22, 2013", 8 pgs.
"European Application Serial No. 10252109.3, Extended Search Report mailed Dec. 18, 2012", 8 pgs.
"European Application Serial No. 10252109.3, Office Action mailed Jan. 21, 2013", 2 pgs.
"European Application Serial No. 10252109.3, Response filed Jul. 16, 2013 to Extended European Search Report mailed Dec. 18, 2012", 15 pgs.
"European Application Serial No. 10252109.3, Response filed Jul. 16, 2013 to Office Action mailed Jan. 21, 2013", 18 pgs.
Mueller, H.Gustav, "Data logging: It's popular, but how can this feature be used to help patients", Hearing Journal. vol. 60, No. 10, (Oct. 1, 2007), 19-20,22.
"U.S. Appl. No. 13/085,033, Corrected Notice of Allowance mailed Sep. 19, 2014", 4 pgs.
"U.S. Appl. No. 13/085,033, Notice of Allowance mailed Aug. 12, 2014", 9 pgs.
"U.S. Appl. No. 13/085,033, Response filed Jun. 17, 2014 to Non Final Office Action mailed Mar. 6, 2014", 9 pgs.
"U.S. Appl. No. 13/085,042, Notice of Allowance mailed Sep. 22, 2014", 5 pgs.
"U.S. Appl. No. 13/189,990, Examiner Interview Summary mailed Sep. 18, 2013", 1 pgs.
U.S. Appl. No. 14/132,821, filed Dec. 18, 2013, System for Evaluating Hearing Assistance Device Settings Using Detected Sound Environment.
U.S. Appl. No. 14/064,994, filed Oct. 28, 2013, Apparatus and Method for Dynamic Detection and Attenuation of Periodic Acoustic Feedback.
"European Application Serial No. 10252109.3, Examination Notification Art. 94(3) mailed Jul. 8, 2015", 6 pgs.
"U.S. Appl. No. 14/579,100, Preliminary Amendment filed Dec. 23, 2015", 6 pgs.
"European Application Serial No. 10252109.3, Response filed Nov. 16, 2015 to Examination Notification Art. 94(3) mailed Jul. 8, 2015", 10 pgs.

* cited by examiner

ACOUSTIC FEEDBACK EVENT MONITORING SYSTEM FOR HEARING ASSISTANCE DEVICES

RELATED APPLICATION

This application is related to U.S. patent application Ser. No. 11/276,795, filed Mar. 14, 2006, which is also published as U.S. Patent Application Publication No. 2007/0217620 on Sep. 20, 2007, and titled: "SYSTEM FOR EVALUATING HEARING ASSISTANCE DEVICE SETTINGS USING DETECTED SOUND ENVIRONMENT," which documents are all incorporated by reference in their entirety.

FIELD OF THE INVENTION

The present subject matter relates generally to hearing assistance devices, including, but not limited to hearing aids, and in particular to an acoustic feedback event monitoring system for hearing assistance devices.

BACKGROUND

Modern hearing assistance devices typically include digital electronics to enhance the wearer's experience. In the specific case of hearing aids, current designs employ digital signal processors rich in features. Modern hearing aids include acoustic feedback cancellation functions. Acoustic feedback cancellation provides very rapid correction of the response of the hearing aid to avoid acoustic feedback. It is difficult to adjust settings of an acoustic feedback cancellation system because they are not limited to electronic or software aspects. These settings are also a function of the acoustics of the environment experienced by the wearer of the device and the fit of the device for the particular wearer.

With the increase of the use of open fit configuration hearing assistance devices, such as receiver-in-the-canal (RIC) or receiver-in-the-ear (RITE) hearing aids, there is an increasing need for higher gain solutions and thus more attention is placed squarely on the acoustic feedback cancellation function. It is important to obtain as much information about the acoustic feedback experienced by the wearer and the operation of the acoustic feedback canceller to provide the desired higher gains with reduced feedback problems for hearing aid wearers.

Audiologists have struggled with lack of information regarding feedback problems that the wearer experienced in use of the hearing aids. Information such as the band at which feedback happens or the severity of the problem is not easy to get from the hearing aid wearer. This may lead to unnecessary reduction in gain at places where feedback is not of a problem resulting in reduced audibility and an unhappy customer.

The options available currently in the market for audiologists are limited. Information that is currently available for an audiologist is typically limited to patient's feedback condition while in the audiologist office. This information is limited and time consuming to acquire.

What is needed in the art is a system for improved monitoring of acoustic feedback events for hearing assistance devices. The system should provide robust and easily accessible information to allow for improved adjustment of hearing assistance devices.

SUMMARY

Disclosed herein, among other things, are methods and apparatus for hearing assistance devices, including, but not limited to hearing aids, and in particular to an acoustic feedback event monitoring system for hearing assistance devices.

The present disclosure relates to tracking of acoustic feedback events of a hearing assistance device, such as a hearing aid. Information about the acoustic feedback events is stored for analysis. Such information is useful for programming acoustic feedback cancellers and other parameters of a hearing assistance device.

In various embodiments, the present subject matter provides apparatus for storing information relating to acoustic feedback events of a hearing assistance device, including a microphone; a receiver; a digital signal processor adapted to process an input signal and generate an output signal, the digital signal processor adapted to perform a process to reduce acoustic feedback between the receiver and the microphone, the digital signal processor further adapted to store information relating to the acoustic feedback events over an extended period of use of the hearing assistance device, wherein the information is accessible for analysis to determine aspects of the acoustic feedback experienced by the hearing assistance device over the extended period of use, the extended period of use including different acoustic environments experienced by a wearer of the hearing assistance device during use of the hearing assistance device. Various embodiments provide multiband or subband approaches. Various embodiments provide storage on the hearing assistance device and remote from the hearing assistance device. Various embodiments store information including one or more of a total number of occurrences of a feedback event, a severity of a feedback event, or a number of feedback events per unit time. Various embodiments include but are not limited to different types of hearing aids, such as behind-the-ear, in-the-ear, and receiver-in-the-canal hearing aids. In various embodiments, wireless communications are provided to perform storage and/or transfer of the information.

Various embodiments provide methods for monitoring performance of a hearing assistance device having an acoustic feedback canceller, the methods including tracking information about a plurality of acoustic feedback events over an extended time interval of use of the hearing assistance device to monitor performance of the acoustic feedback canceller in different acoustic environments experienced by a wearer of the hearing assistance device; and storing the information for analysis. Various embodiments provide multiband or subband approaches. Various embodiments provide storage on the hearing assistance device and remote from the hearing assistance device. Various embodiments store information including one or more of a total number of occurrences of a feedback event, a severity of a feedback event, or a number of feedback events per unit time. Various embodiments include but are not limited to different types of hearing aids, such as behind-the-ear, in-the-ear, and receiver-in-the-canal hearing aids. In various embodiments, wireless communications are provided to perform storage and/or transfer of the information.

This Summary is an overview of some of the teachings of the present application and not intended to be an exclusive or exhaustive treatment of the present subject matter. Further details about the present subject matter are found in the detailed description and appended claims. The scope of the present invention is defined by the appended claims and their legal equivalents.

DETAILED DESCRIPTION

The following detailed description of the present subject matter refers to subject matter in the accompanying drawings which show, by way of illustration, specific aspects and embodiments in which the present subject matter may be practiced. These embodiments are described in sufficient detail to enable those skilled in the art to practice the present subject matter. References to "an", "one", or "various" embodiments in this disclosure are not necessarily to the same embodiment, and such references contemplate more than one embodiment. The following detailed description is demonstrative and not to be taken in a limiting sense. The scope of the present subject matter is defined by the appended claims, along with the full scope of legal equivalents to which such claims are entitled.

The present subject matter relates generally to hearing assistance devices, including, but not limited to hearing aids, and in particular to an acoustic feedback event monitoring system for hearing assistance devices.

Figure 1:
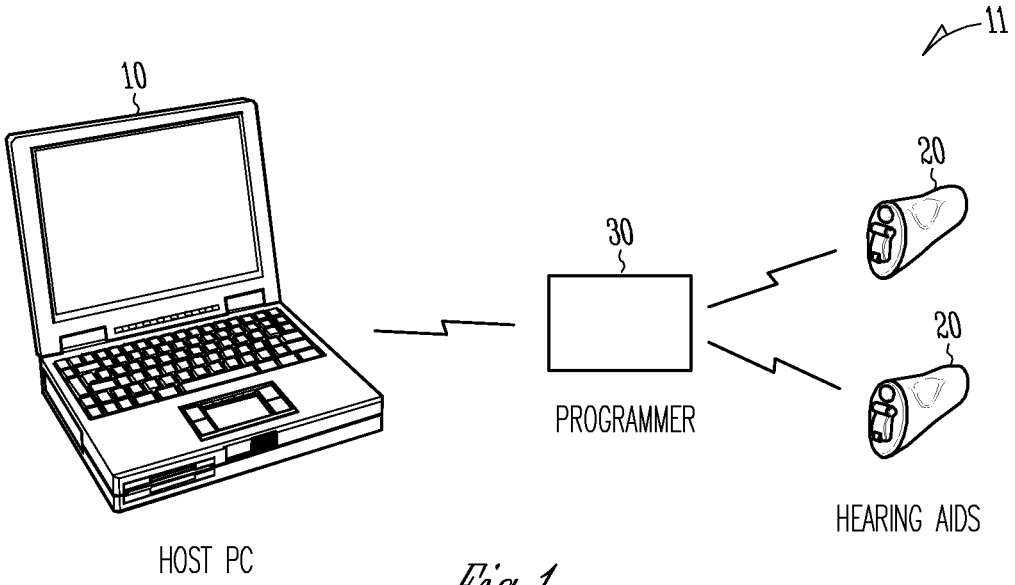
FIG. 1 is a block diagram showing hearing assistance devices and programming equipment, according to one embodiment of the present subject matter.

FIG. 1 is a block diagram of a system 11 showing a pair of hearing assistance devices and programming equipment, according to one embodiment of the present subject matter. FIG. 1 shows a host computer 10 in communication with the hearing assistance devices 20. In one application, the hearing assistance devices 20 are hearing aids. Other hearing assistance devices and types of hearing aids are possible without departing from the scope of the present subject matter. In various embodiments a programmer 30 is used to communicate with the hearing assistance devices 20; however, it is understood that the programmer functions may be embodied in the host computer 10 and/or in the hearing assistance devices 20 (e.g., hearing aids), in various embodiments. Programmer 30 thus functions to at least facilitate communications between the host computer 10 and the hearing assistance devices 20 (e.g., hearing aids), and may contain additional functionality and programming in various embodiments.

The present subject matter provides a means for tracking acoustic feedback events over an extended period of time. The tracking algorithm executes on each hearing aid to be monitored. In various embodiments, the tracking algorithm is performed by the digital signal processor to save acoustic feedback events for analysis. In various embodiments, it is possible that the tracking algorithm can operate at least in part on another device, including, but not limited to, the host computer 10, the programmer 30, another hearing aid 20, or on combinations of the foregoing. It is possible that the tracking algorithm can be executed on another device provided it accesses or obtains information about the feedback event experienced and/or operation of the feedback canceller as it operates on the hearing assistance device.

A good feedback detector in a multiband device can detect accurately the occurrence of feedback in a particular band. A hearing aid that has stored these feedback events is a good source of information for audiologists during follow up visits from hearing aid users. It is understood that such follow ups need not be in person and that using remote access technology, the feedback event data can be reviewed and processed remotely. Device parameters can be adjusted remotely as well. Upon reviewing the feedback event information, the audiologist can set the gain in the hearing aid to suit audibility needs while making the most educated guess to avoid potential feedback problems. In various embodiments, this can be based on the wearer's hearing loss and any preliminary calculation of maximum stable gain of the hearing aid. The hearing aid wearer is asked to come back for a follow up visit at a later time, such as one or two weeks. Other times may be used without departing from the scope of the present subject matter. During this time a feedback tracking algorithm can be run on the hearing aid, or aids, to be monitored. In various embodiments, the tracking algorithm is continually run on the hearing aid. In various embodiments, the tracking algorithm is activated during the 1 to 2 week monitoring period, depending on the preference of the audiologist. In various embodiments, the tracking algorithm is activated upon certain programmable events, such as an acoustic environment change, occurrence of multiple acoustic feedback events, or other programmable events. In various embodiments, there are means in the fitting software to disable or reset the feedback tracking algorithm.

In some embodiments, the feedback tracking algorithm constantly monitors information including, but not limited to, the total number of occurrences of feedback, severity of the feedback, and/or a number of feedback occurrences per unit time until the next follow up. If needed to avoid false alarms, the feedback tracking algorithm can be disabled for a few seconds after power up so that feedback due to insertion of hearing aid into ear is not taken into consideration. The data is collected over an interval of time until the follow up session.

When the hearing aid user comes back to the audiologist office (or in the case of a remote visit, when the data is provided to the audiologist), the fitting software will display the information that would help the audiologist to fine tune the prescribed gain to minimize feedback problems. This allows gain to be reduced in bands of high feedback problems and increase gain (if needed) in bands with no feedback problems. Higher the probability of feedback in a band, more gain reduction can be prescribed in that band. This will ensure that the hearing aid performance is maximized to provide increased audibility while reducing risks of feedback in a convenient, straight forward manner.

Figure 2:
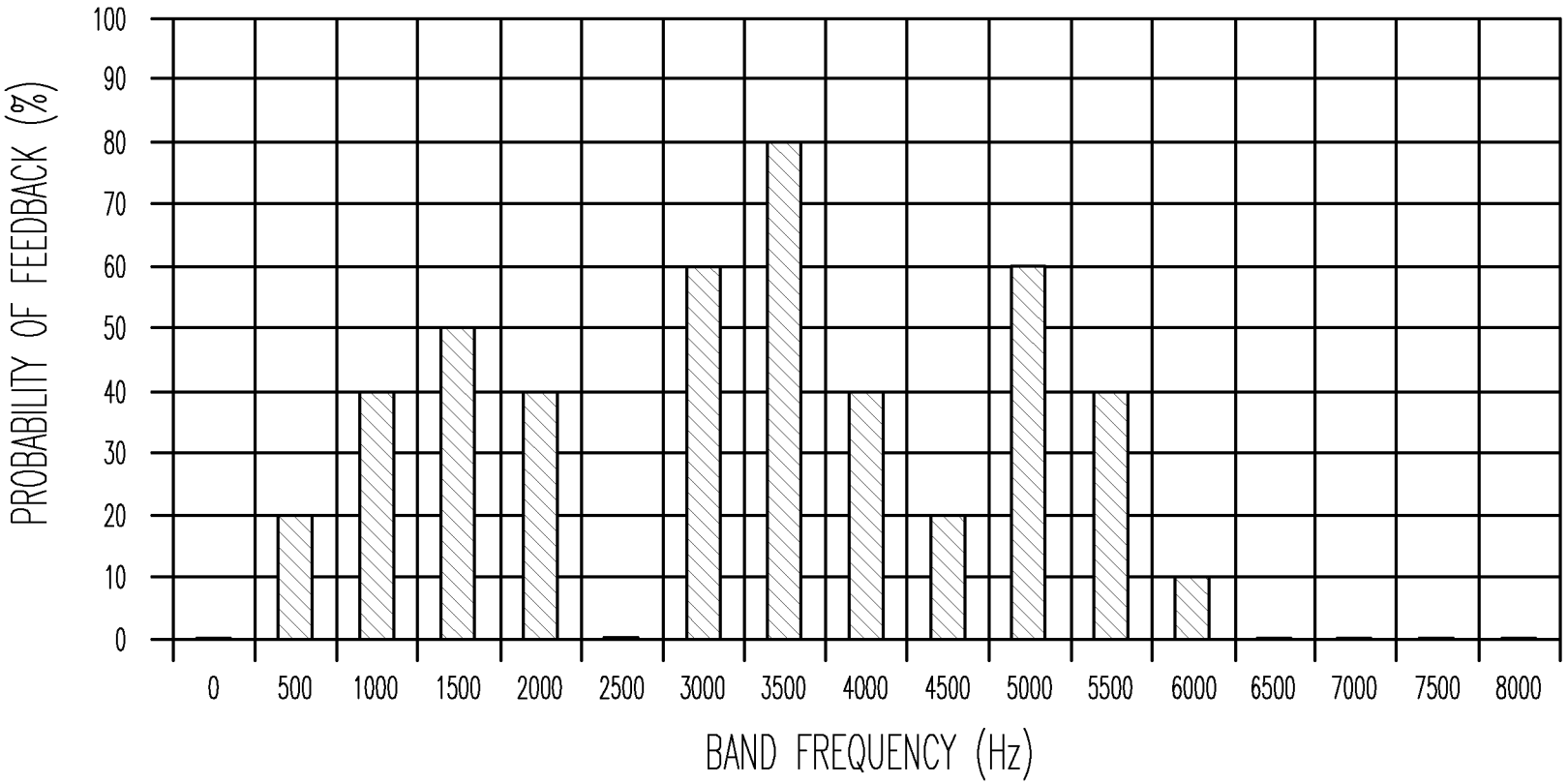
FIG. 2 demonstrates one type of output possible with the present system, according to one embodiment of the present subject matter.

FIG. 2 demonstrates one type of output possible with the present system, according to one embodiment of the present subject matter. The data representing feedback occurrences at particular frequencies is statistically collected and provided as a histogram in this example. This type of output tells the audiologist the likelihood of feedback as a function of frequency for a relatively large sample space as opposed to a limited amount of information found during a patient visit. There are different ways that the fitting software can display the information on feedback. Thus, the present discussion is demonstrative and not intended to be an exhaustive or exclusive depiction of the system and its operation.

In various embodiments, the feedback tracking algorithm is adapted to run on the digital signal processor of the hearing assistance device. In some embodiments, the data is statistically collected and stored in memory resident in the hearing aid. In various embodiments, the data is transferred to another storage device. Such devices include data storage accessible over the INTERNET or other network, a personal data storage, such as a personal digital assistant, iPod, cellular phone, or other digital storage device. Such transfer may be performed in a wired or wireless approach, or via a recharging step where the data is downloaded. The wireless approaches including, but are not limited to radio frequency transmission or magnetic coupling transmission. In some embodiments, the data is logged for later processing, such as set forth in U.S. patent application Ser. No. 11/276,795 filed Mar. 14, 2006, which is also published as U.S. Patent Application Publication No. 2007/0217620 on Sep. 20, 2007, titled: "SYSTEM FOR EVALUATING HEARING ASSISTANCE DEVICE SETTINGS USING DETECTED SOUND ENVIRONMENT," which documents are all incorporated by reference in their entirety.

Figure 3:
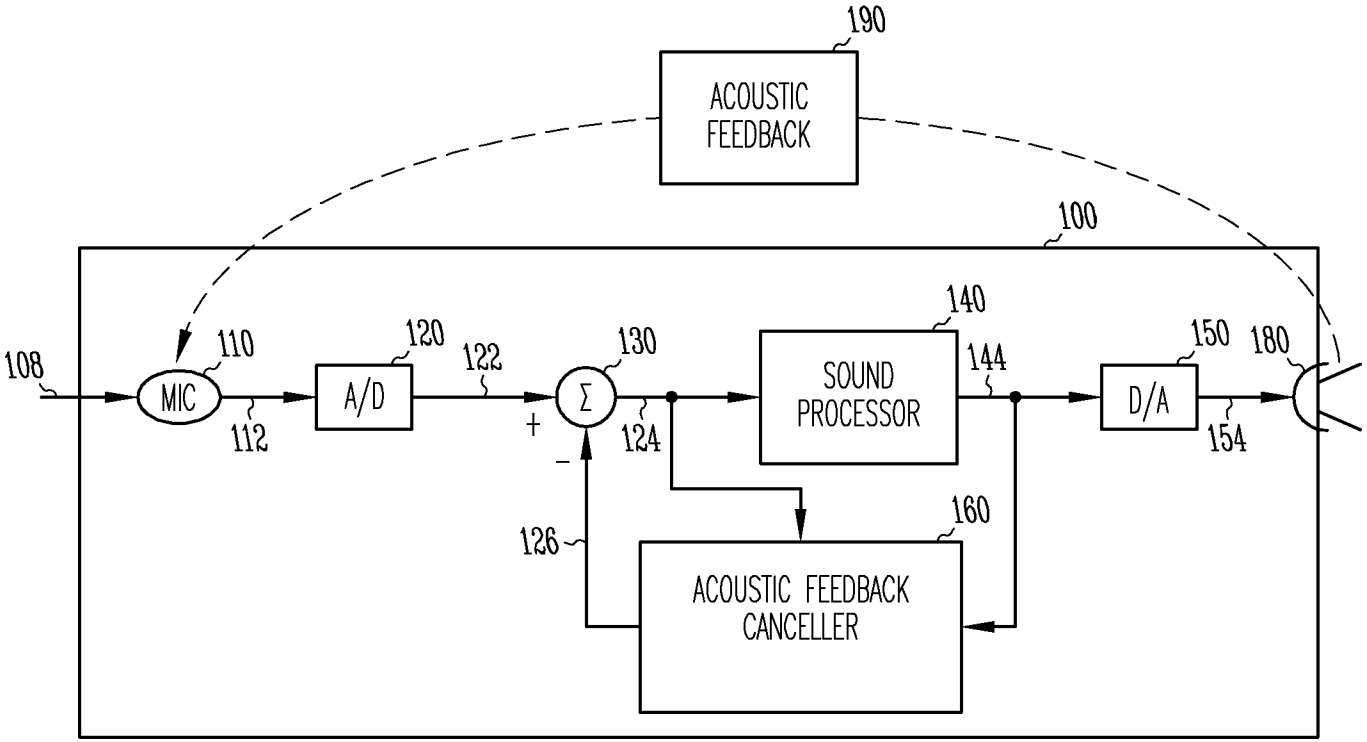
FIG. 3 shows a functional block diagram of a hearing assistance system according to one embodiment of the present invention and a representation of an acoustic feedback path.

FIG. 3 shows a functional block diagram of a hearing assistance system according to one embodiment of the present invention and a representation of an acoustic feedback path. The hearing assistance system 100 includes a microphone 110, which receives input sound 108 and provides a signal 112 to an analog-to-digital converter 120. A digital representation 122 of the signal 112 is provided to the summer 130. The summer 130, sound processor 140 and acoustic feedback estimator with adaptive bulk delay 160 are configured in a negative feedback configuration to provide a cancellation of the acoustic feedback 190. In FIG. 3, the input sound 108 is desired signal and conceptually separate from acoustic feedback 190. In providing the cancellation, signal 124 represents a form of error signal to assist in producing the acoustic feedback estimate 126 from acoustic feedback estimator with adaptive bulk delay 160. Sound processor 140 can be implemented to provide a number of signal processing tasks, at least some of which are found in hearing assistance systems. The resulting processed digital output 144 is received by driver 150 and used to drive receiver 180. In one embodiment, driver 150 is a digital to analog converter and amplifier combination to drive receiver 180. In one embodiment, driver 150 is a direct drive. In one embodiment, driver 150 is a pulse width modulator. In one embodiment, driver 150 is a pulse density modulator. Receiver 180 also can vary. In one embodiment, receiver 180 is a speaker. In on embodiment, receiver 180 is a transducer. Other drivers and receivers may be used without departing from the scope of the present subject matter.

Digital output 144 is provided to the acoustic feedback estimator with adaptive bulk delay 160 to create the acoustic feedback estimate 126. Summer 130 subtracts acoustic feedback estimate 126 from digital representation 122 to create error signal 124.

It is understood that various amplifier stages, filtering stages, and other signal processing stages are combinable with the present teachings without departing from the scope of the present subject matter.

The sound cancellation is necessary since acoustic output from the receiver 180 invariably couples with the microphone 110 through a variety of possible signal paths. Some example acoustic feedback paths may include air paths between the receiver 180 and microphone 110, sound conduction paths via the enclosure of hearing assistance system 100, and sound conduction paths within the enclosure of hearing assistance system 100. Such coupling paths are collectively shown as acoustic feedback 190.

If properly implemented the feedback system of FIG. 3 will produce an acoustic feedback estimate 126 which is closely modeled after acoustic feedback 190. Summer 130 will subtract the acoustic feedback estimate 126 from signal 122, thereby cancelling the effect of acoustic feedback 190 in signal 124. As the cancellation becomes ideal signal 124 approaches signal 122, which is a digital representation of input sound 108. It is noted that signal 124 is called an error signal only because it represents error to the closed loop system (that is when it departs from signal 122 that is error). When working properly, the information on error signal 124 is the desired sound information from input sound 108. Thus, the "error" nomenclature does not mean that the signal is purely error, but rather that its departure from the desired signal indicates error in the closed loop feedback system.

The acoustic feedback cancellation is performed using the digital signal processor (DSP) in digital embodiments. The DSP can be used to perform the feedback event tracking function of the present subject matter. Multiband or subband implementations can involve acoustic feedback cancellation that is performed on a band-by-band basis. Therefore collection of acoustic feedback events per band is relatively straightforward.

The present subject matter can be used for a variety of hearing assistance devices, including but not limited to, cochlear implant type hearing devices, hearing aids, such as behind-the-ear (BTE), in-the-ear (ITE), in-the-canal (ITC), or completely-in-the-canal (CIC) type hearing aids. It is understood that behind-the-ear type hearing aids may include devices that reside substantially behind the ear or over the ear. Such devices may include hearing aids with receivers associated with the electronics portion of the behind-the-ear device, or hearing aids of the type having receivers in the ear canal of the user. Such devices are also known as receiver-in-the-canal (RIC) or receiver-in-the-ear (RITE) hearing instruments. It is understood that other hearing assistance devices not expressly stated herein may fall within the scope of the present subject matter.

This application is intended to cover adaptations or variations of the present subject matter. It is to be understood that the above description is intended to be illustrative, and not restrictive. The scope of the present subject matter should be determined with reference to the appended claims, along with the full scope of legal equivalents to which such claims are entitled.

What is claimed is:

1. A hearing assistance device configured to store information relating to acoustic feedback events of the hearing assistance device, comprising:

a microphone to receive sound and convert it to an input signal;

a receiver to play output sound based on an output signal; and a digital signal processor adapted to process the input signal and generate the output signal, the digital signal processor adapted to perform a subband process to reduce acoustic feedback between the receiver and the microphone on a band-by-band basis of at least some subbands of the subband process, the digital signal processor further adapted to store information relating to the acoustic feedback events for one or more subbands of the at least some subbands over an extended period of use of the hearing assistance device, and the digital signal processor is configured to store the information including an indication of a magnitude of severity of a feedback event of the acoustic feedback events, wherein the digital signal processor is configured to reduce acoustic feedback at least in part using subtraction of an acoustic feedback estimate, wherein the information is accessible for analysis to determine aspects of the acoustic feedback experienced by the hearing assistance device over the extended period of use for the one or more subbands, the extended period of use including different acoustic environments experienced by a wearer of the hearing assistance device during use of the heating assistance device, and wherein the digital signal processor is configured to store information upon occurrence of a programmable event and to disable storing information relating to the acoustic feedback events during power up of the device so that feedback due to insertion of hearing assistance device into an ear is not stored.

2. The hearing assistance device of claim 1, comprising a radio frequency signal transmitter.

3. The hearing assistance device of claim 1, wherein the digital signal processor is configured to store the information to memory in the hearing assistance device.

4. The hearing assistance device of claim 1, wherein the digital signal processor is adapted to store the information including one or more of a total number of occurrences of the acoustic feedback events and a number of the acoustic feedback events per unit time.

5. The hearing assistance device of claim 1, wherein the digital signal processor is adapted to store statistical information about acoustic feedback events.

6. The hearing assistance device of claim 1, wherein the microphone and digital signal processor are disposed in a housing adapted to be worn on or behind a wearer's ear and the receiver is connected to the housing with wires.

7. The hearing assistance device of claim 1, wherein the microphone, digital signal processor, and receiver are disposed in a housing adapted to fit in a wearer's ear.

8. The hearing assistance device of claim 1, wherein the microphone, digital signal processor, and receiver are disposed in a housing adapted to fit behind a wearer's ear.

9. The hearing assistance device of claim 1, further comprising wireless electronics adapted to perform wireless communication of the information.

10. The hearing assistance device of claim 9, wherein the digital signal processor is configured to store the information to memory outside of the hearing assistance device.

11. The hearing assistance device of claim 1, comprising a magnetic signal transmission apparatus.

12. The hearing assistance device of claim 1, wherein the hearing assistance device is configured to transfer data during at least a recharging process.

13. The hearing assistance device of claim 1, comprising a radio frequency signal transmitter, and wherein the hearing assistance device is configured to transmit the information to a remote device using the radio frequency signal transmitter, the information including statistical information relating to the acoustic feedback.

14. The hearing assistance device of claim 1, comprising a magnetic signal transmitter, and wherein the hearing assistance device is configured to transmit the information to a remote device using the magnetic signal transmitter, the information including statistical information relating to the acoustic feedback.

15. A method for monitoring performance of a hearing assistance device having an acoustic feedback canceller, the method comprising:

performing acoustic feedback cancellation using the acoustic feedback canceller and at least a subtraction of an acoustic feedback estimate, the acoustic feedback cancellation performed using a digital subband process that provides feedback cancellation over at least some subbands of the digital subband process;

tracking information about acoustic feedback events over an extended time interval of use of the hearing assistance device to monitor performance of the acoustic feedback canceller in different acoustic environments experienced by a wearer of the hearing assistance device, wherein the tracking is activated upon occurrence of a programmable event; and storing the information, including storing an indication of a magnitude of severity of a feedback event of the acoustic feedback events, wherein the tracking is automatically disabled during power up of the device so that feedback due to insertion of the hearing assistance device into an ear is not stored.

16. The method of claim 15, further comprising activating the tracking upon predetermined events.

17. The method of claim 15, wherein the tracking is disabled by instruction the hearing assistance device.

18. The method of claim 15, wherein the storing is performed in the hearing assistance device.

19. The method of claim 15, wherein the storing is performed in data storage remote from the hearing assistance device.

20. The method of claim 15, wherein the storing is performed using the INTERNET.

21. The method of claim 15, wherein the information includes one or more of a total number of occurrences the acoustic feedback events and a number of the acoustic feedback events per unit time.

22. The method of claim 15, further comprising providing the information to a programming system to analyze the acoustic feedback events.

23. The method of claim 22, wherein a histogram is generated using the information.

24. The method of claim 15, further comprising wirelessly transmitting the information to another device.

25. The method of claim 15, further comprising transmitting the information using a radio frequency signal transmission apparatus.

26. The method of claim 15, further comprising transmitting the information using a magnetic signal transmission apparatus.

27. The method of claim 15, further comprising:

transmitting the information to another device at least during a portion of a process for recharging the hearing assistance device.

* * * * *